US005795088A

United States Patent [19]

Wen et al.

[11] Patent Number: 5,795,088

[45] Date of Patent: Aug. 18, 1998

[54] PLATEN ROLLER SLEEVED WITH HEAT SHRINKING TUBE FOR IMPROVED COLOR REGISTRATION IN A PLATEN-DRIVE RESISTIVE THERMAL PRINTER

[75] Inventors: Xin Wen, Rochester; Joseph C. Olsovsky, North Chili, both of N.Y.

[73] Assignee: Eastman Kodak Company, Rochester, N.Y.

[21] Appl. No.: 748,464

[22] Filed: Nov. 8, 1996

[51] Int. Cl.[6] ..... B41J 11/057

[52] U.S. Cl. ..... 400/662; 400/659; 347/220

[58] Field of Search ..... 400/662, 659, 400/661.1; 347/220

[56] References Cited

U.S. PATENT DOCUMENTS

| | | | |
|---|---|---|---|
| 4,092,920 | 6/1978 | Barnak | 101/92 |
| 4,198,739 | 4/1980 | Budinger et al. | 101/348 |
| 4,327,366 | 4/1982 | Schafter et al. | 347/220 |
| 4,374,223 | 2/1983 | Van Raamsdonk et al. | 524/245 |
| 4,583,272 | 4/1986 | Keller | 400/661.1 |
| 5,021,804 | 6/1991 | Nozawa et al. | 347/220 |
| 5,078,519 | 1/1992 | Takita et al. | 400/636.1 |
| 5,244,861 | 9/1993 | Campbell et al. | 503/227 |
| 5,245,923 | 9/1993 | Vrotacoe | 101/217 |
| 5,673,078 | 9/1997 | Wen et al. | 400/662 |

FOREIGN PATENT DOCUMENTS

| | | | |
|---|---|---|---|
| 402029361 | 1/1990 | Japan | 400/662 |

*Primary Examiner*—Edgar S. Burr
*Assistant Examiner*—Amanda B. Sandusky
*Attorney, Agent, or Firm*—Walter S. Stevens

[57] ABSTRACT

A resistive thermal printer has a platen drive mechanism which includes (1) a thermal printhead having an array of selectively-activatable thermal elements and (2) a rotatably-driven platen roller opposed to the printhead and forming a nip with the printhead through which a receiver medium is driven by the platen roller while the thermal elements are selectively activated. The platen roller has an inner core and an outer sleeve formed of a heat shrunk material. The platen roller includes a compliant layer below the outer sleeve.

33 Claims, 2 Drawing Sheets

PLATEN ROLLER SLEEVED WITH HEAT SHRINKING TUBE FOR IMPROVED COLOR REGISTRATION IN A PLATEN-DRIVE RESISTIVE THERMAL PRINTER

CROSS-REFERENCE TO RELATED APPLICATIONS

Reference is made to commonly assigned, co-pending U.S. patent applications Ser. No. 08/641,250 entitled THERMAL PRINTER WHICH RECIRCULATES RECEIVER SHEET BETWEEN SUCCESSIVE PRINTING PASSES, which was filed in the names of Maslanka et al. on Apr. 30, 1996 and Ser. No. 08/697,323 entitled COATED PLATEN ROLLER FOR IMPROVING REGISTRATION IN A PLATEN-DRIVE RESISTIVE THERMAL PRINTER, which was filed in the names of Wen et al. on Aug. 23, 1996.

BACKGROUND OF THE INVENTION

1. Technical Field

This invention relates to resistive thermal printing, and, more particularly, to resistive thermal printing of the type in which a dye donor medium and a dye receiver medium are fed between a resistive thermal printhead and a compliant platen roller for image-wise transfer of image material contained on the dye donor medium to the dye receiver medium. It is particularly useful in a printer in which successive dye images in different colors are transferred to the receiver medium in registration to form a multicolor dye image on the dye receiver medium.

2. Background Art

In a resistive thermal printer, a dye receiver medium, such as a sheet or web, and a donor medium are fed together through a printing nip between a resistive thermal printhead and a rotatable platen. The printhead image-wise heats the donor medium to transfer dye or another image material in image configuration to the receiver medium as the donor medium and receiver medium pass through the nip. To make multicolor images, the receiver medium is passed again through the nip with a different color dye donor medium.

As is well known in the art, a resistive thermal printhead utilizes a row of closely spaced resistive elements which are selectively energized to record data in hard copy form. The resistive elements receive energy from a power supply through driver circuits in response to the stored digital information related to text, bar codes, pictorial, or graphical images. The heat from each energized element may be applied directly to thermal sensitive material or to a dye-coated donor medium to cause transfer of the dye by diffusion to paper or other receiver medium material.

The receiver medium transport mechanism in a resistive thermal dye transfer print engine requires two mechanical functions. First, compliance must be provided to the receiver medium at the printheadreceiver medium interface so that images can be printed uniformly on the receiver medium. Second, a receiver medium transport that is repeatable to all color planes is necessary.

Three resistive thermal printer mechanisms are shown in FIGS. 1–3. FIG. 1 illustrates a printer 10 having a platen roller 12 to which a receiver medium 14 is attached by a clamp 16. The platen roller provides compliance at the nip interface between the platen roller and a printhead 18. FIG. 2 shows a printer 20 having a platen roller 22 and a pair of pinch rollers 24 and 26 which drive receiver medium 28 through the nip of platen roller 22 and a printhead 30. In the prior art embodiments of FIGS. 1 and 2, clamp 16 and pinch rollers 24 and 26, respectively, tightly hold the receiver medium during the printing of all color planes.

FIG. 3 shows a printer 32 with a platen-drive mechanism disclosed in commonly assigned, co-pending U.S. patent application Ser. No. 08/641,250 entitled THERMAL PRINTER WHICH RECIRCULATES RECEIVER SHEET BETWEEN SUCCESSIVE PRINTING PASSES, which was filed in the names of Maslanka et al. on Apr. 30, 1996. A receiver medium 34 is moved through a closed loop path (partially shown) to accomplish a plurality of passes through a nip between a resistive thermal printhead 36 and a platen roller 38. The platen roller itself drives the receiver medium and a donor medium 40 through the nip, simplifying the apparatus. The two functions of compliance and transport are both fulfilled by the platen roller. This platen-drive mechanism has the advantages of fewer parts, and thus lower cost, compared to the two mechanisms of FIGS. 1 and 2. However, since receiver medium 34 is not firmly held by any mechanical parts, misregistration between color planes may occur in this mechanism.

A platen roller in a resistive thermal printer is typically comprised of a rigid shaft, usually made of metal for mechanical strength, and an elastomer layer wrapped around the shaft for compliance. In U.S. Pat. No. 5,078,519, the receiver medium is transported by a capstan-roller mechanism. During printing, the slack in the receiver medium between the axes of the platen roller and the capstan rollers causes skew distortion on the print. Since the receiver medium is driven by both the pair of pinch rollers and the platen roller, the slack in the receiver medium tends to stay during the printing process. If the receiver medium can be allowed to slide on the platen roller, the slack in receiver medium can be eliminated. The technique disclosed in U.S. Pat. No. 5,078,519 is used to decrease the coefficient of friction between the receiver medium and the platen roller by coating a layer of Teflon™ resin on the outer surface of the platen roller.

Color misregistration in platen-drive resistive thermal printers originates from the sensitivity of the elastomer layer to external force variations. The image densities are usually different between color planes (in non-neutral images), and different amounts of heat are applied by the printhead in printing different color planes. The difference in printing temperatures affect the coefficient of friction at the printhead-donor medium interface, which leads to variations in the resistive forces on the donor medium, the receiver medium, and the platen roller. This variation in the resistive forces produces different amount of shear distortion (or wind up) in the rubber layer on the platen roller, which leads to different movements in the receiver medium in different color planes, that is, color misregistration.

One technique that can reduce shear distortion and thus color misregistration in a platen-drive mechanism is to increase the shear modulus in the elastomer layer of the platen roller. But an increase in the shear modulus tends also to decrease the compliance in the platen roller, which is undesired for printing uniformity.

U.S. patent application Ser. No. 08/697,323 entitled COATED PLATEN ROLLER FOR IMPROVING REGISTRATION IN A PLATEN-DRIVE RESISTIVE THERMAL PRINTER, which was filed in the names of Wen et al. on Aug. 23, 1996, discloses a platen roller structure that improves color misregistration without compromising compliance in the platen drive mechanism. The platen roller consists of a soft layer made of elastomers such as silicone or polyurethane, as in typical platen rollers. The outer surface of the platen roller is coated with a thin layer of polyfluorinated polymers. The coefficient of friction of the platen roller is reduced by the polyfluorinated polymer coating. It is believed that the polyfluorinated polymer coating improves the color registration by containing the elastomer layer and the bulging effect that occurs when the elastomeric layer is driven through the nip.

While polyfluorinated polymer improved the color registration in a platen drive mechanism, its performance is dependent on the coating structure of the back surface of the thermal receiver medium. In experiments, the receiver structure (disclosed in commonly assigned U.S. Pat. No. 5,244,861) contains a paper stock Vintage Gloss that is extrusion laminated with a microvoided composite film. A subbing layer, a dye receiving layer, and a dye receiver overcoat layer are sequentially coated on top of the composite film. The backside of the receiver is first extrusion coated with a layer of high density polyethylene (30 g/m$^2$) and then coated with a layer for antistatic charge. The antistatic layer contains 4% polystyrene beads of 3–4 μm in diameter. Polyfluorinated polymer coating on the platen rollers improved the color registration in the platen-drive mechanism.

The polystyrene beads coated on the back surface of the receiver sheets tend to extrude out of the substrate surface, which increases the friction and causes "grabbing" between the receiver and the platen. Unfortunately, some polystyrene beads also have the tendency to fall off of the receiver. The loose beads tend to accumulate between the printhead and the front side of the receiver, producing print non-uniformities. Accordingly, a resistive thermal printer is desired that prints on receiver medium that does not contain polystyrene beads on the back surface of the thermal receiver medium. When this type of thermal receiver is used in a platen-drive mechanism equipped with a polyfluorinated polymer coated platen roller, it is observed that the thermal receiver frequently stalls before the nip interface, and printing fails to occur.

DISCLOSURE OF THE INVENTION

It is an object of the present invention to overcome the above-mentioned difficulty by providing a platen roller structure that improves color registration, and which can be used for printing on thermal receiver media that either contains polystyrene beads on the back surface or that does not contain polystyrene beads on the back surface.

According to a feature of the present invention, a cylindrical platen roller has an inner core and an outer sleeve formed of a heat shrunk material.

According to another feature of the present invention, the inner core of the platen roller includes a compliant layer.

According to yet another feature of the present invention, the compliant layer is an elastomer.

According to preferred embodiments of the present invention, the inner core includes a compliant layer on an rigid shaft, and the material of the sleeve is polyolefin. Alternatively, the material may be neoprene, silicone, fluorocarbons, or cross-linked PVC. A layer of adhesive may be provided between the core and an outer sleeve.

The cylindrical platen roller may be used on a resistive thermal printer opposed to a printhead and forming a nip with the printhead through which a receiver medium is driven for forming an image on a receiver medium. The roller may be rotatably-driven to drive a receiver medium through the nip.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
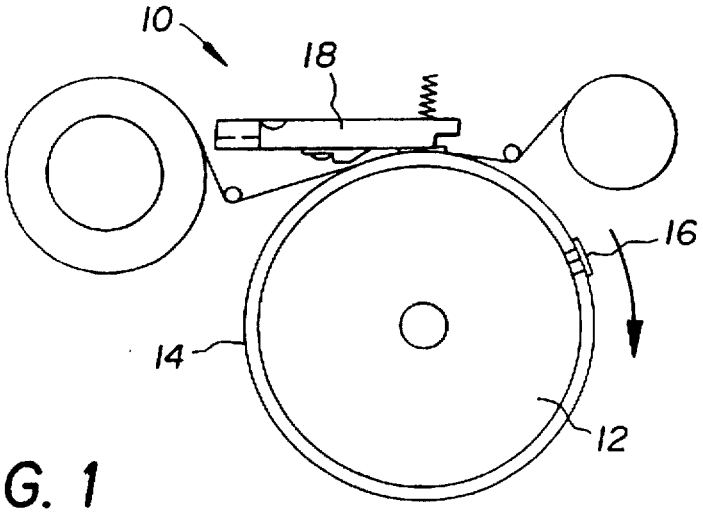
FIG. 1 (PRIOR ART)
FIG. 1 is a schematic side view of a clamp and drum receiver medium transport mechanism known in the prior art.
Figure 2:
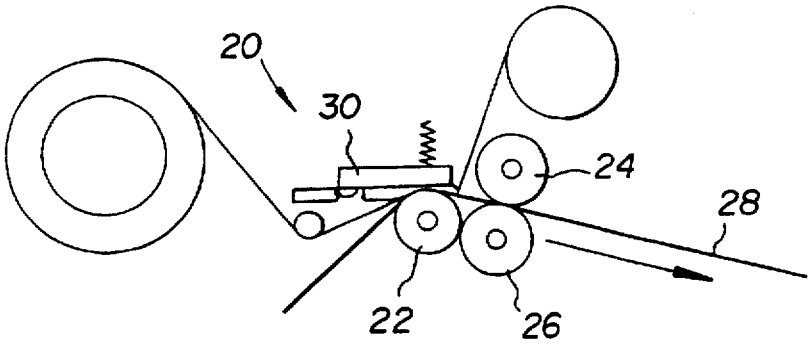
FIG. 2 (PRIOR ART)
FIG. 2 is a schematic side view of a capstan roller receiver medium transport mechanism known in the prior art.
Figure 3:
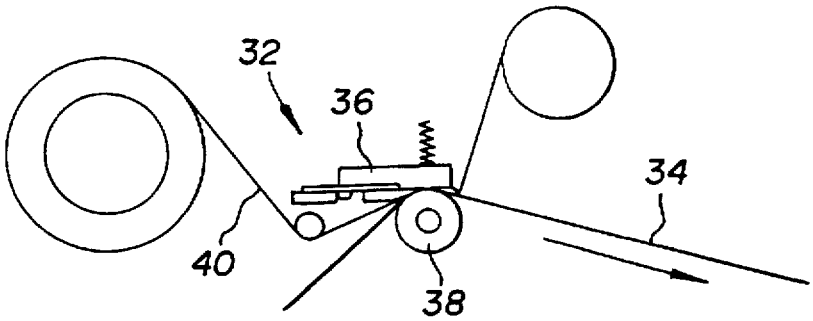
FIG. 3 (PRIOR ART)
FIG. 3 is a schematic side view of a platen drive receiver medium transport mechanism known in the prior art.
Figure 4:
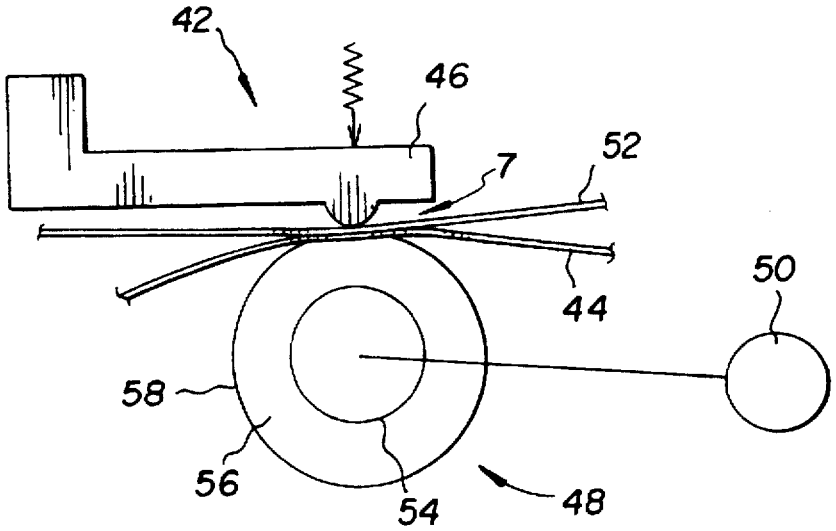
FIG. 4 is a schematic side view of a platen drive receiver medium transport mechanism according to the present invention.

Referring now to FIG. 4, there is shown a portion 42 of a dye transfer thermal printer apparatus similar to that of FIG. 3, but including structure according to the present invention. Receiver medium 44 is moved through a nip between a resistive thermal printhead 46 and a platen roller 48. The platen roller is driven by a drive power source such as a motor 50, and itself drives the receiver medium and a donor medium 52 through the nip.

Platen roller 48 includes a rigid shaft 54, usually made of metal for mechanical strength, and a compliant layer 56, such as an elastomer, wrapped around the shaft for compliance. According to the present invention, compliant layer 56 is tightly sleeved by a heat shrinkable polyolefin tube 58.

As an example of the invention concept, the outer diameter of platen roller 48 may be 0.710 inch and the elastomer layer may be 0.105 inch thick tubing.

An example of a procedure of mounting the heat shrinkable sleeve follows. A 0.5" thick steel shaft is extrusion molded with silicone rubber at 20 Shore "A" durometer. The elastomer layer is ground-finished to an outer diameter of 0.680". A heat shrinkable polyolefin tube (available from 3M Company) with 0.035" thickness and 1.0" diameter is cut to the same length as the length of the elastomer layer on the platen. The platen roller is then placed inside the heat shrinkable tube. The platen roller, which is loosely wrapped with the polyolefin tube, is then mounted on a bench center and heated by a heat gun. The heating is started from the axial center of the platen roller so that air is not trapped under the tube as it is shrunk into contact with the silicone rubber. The roller is rotated and the heating gun is uniformly moved back and forth for homogeneous shrinking. In a few minutes the tube is tightly wrapped around the silicone layer. To ensure good binding between the tube and the elastomer layer, adhesives may be applied to the elastomer layer or the inside of the tube before heating. In the example, the diameter of the roller sleeved with tubing is measured at 0.750". The polyolefin material in the sleeve is then ground to finish the platen roller at a final platen diameter of 0.710".

It is understood that the above described procedure is used to demonstrate the present invention. Many variations may be made by those skilled in the art. First, different heat shrinkable tubing materials can be used. For example, a range of heat tubing materials such as polyolefin, neoprene, silicone, fluorocarbon, and (cross-linked) PVC are available from Raychem. Second, the shrinking ratio of the tubing materials can vary in the range of about 1.25-to-1 to about 4-to-1. Third, the shrinking tubing can retain different diameters and thicknesses, although tubing thickness is best selected to be the same as, or a little thinner than, that of the final platen roller so that the grinding step is eliminated. For better shrinking uniformity, it is desired to start with a tubing diameter not much larger than the diameter of the platen roller, as shown in the above example. Fourth, the internal surfaces of some tubes can be coated with adhesives (available from Raychem). These adhesives help the binding between the tube and the elastomer. Fifth, higher friction coefficient is desired for the tube material. It is believed the improvement in this invention is partially related to the more frictionous surface finish on the final platen rollers.

During testing of the apparatus, two platen rollers were mounted in a platen drive mechanism for testing color misregistration. One of the rollers had a polyolefin material heat shrunk sleeve, and the other did not. Receiver mediums were supplied in the form of cut sheets. The antistatic charge layer on the back surface of the receiver sheets does not contain polystyrene beads. The test image used contained fiducial marks along two in-line sides of the print with constant spacing and a uniform magenta field at maximum density. This test image was used to produce maximum difference in the friction force between color planes and thus the maximum color misregistration. The worst color misregistration occurred at the bottom of the prints. Multiple prints were made at 5 ms/line using each of the two platen rollers. The performance of the two rollers are summarized in the following table, which compares the color registration offset of the yellow and magenta color planes relative to the cyan color plane in the down-the-page direction for a platen roller with a polyolefin material heat shrunk sleeve and a platen roller with no sleeve or coating. Clearly, the platen roller with a polyolefin material heat shrunk sleeve gives much improved color registration compared to a platen roller without a sleeve or coating.

TABLE

| | Offset (0.001 inch) | |
|---|---|---|
| | Roller without sleeve or coating | Roller with polyolefin heat shrunk sleeve |
| Average Misregistration | −19.1 | 0.8 |
| Standard Deviation | 1.9 | 2.6 |

The present invention enables the application of a low cost platen drive mechanism. It improves color registration without dependence on a back coating on the thermal receiver media. The invention improves color registration without changing printing procedures.

The invention has been described in detail with particular reference to preferred embodiments thereof, but it will be understood that variations and modifications can be effected within the spirit and scope of the invention.

| | |
|---|---|
| 10 resistive thermal printer | 56 compliant layer |
| 12 compliant platen roller | 58 sleeve |

-continued

| | |
|---|---|
| 14 dye receiver medium | 60 |
| 16 clamp | 62 |
| 18 thermal printhead | 64 |
| 20 resistive thermal printer | 66 |
| 22 compliant platen roller | 68 |
| 24 pinch roller | 70 |
| 26 pinch roller | 72 |
| 28 dye receiver medium | 74 |
| 30 thermal printhead | 76 |
| 32 resistive thermal printer | 78 |
| 34 dye receiver medium | 80 |
| 36 thermal printhead | 82 |
| 38 compliant platen roller | 84 |
| 40 dye donor medium | 86 |
| 42 resistive thermal printer portion | 88 |
| 44 receiver medium | 90 |
| 46 resistive thermal printhead | 92 |
| 48 platen roller | 94 |
| 50 drive power source motor | 96 |
| 52 donor medium | 98 |
| 54 rigid shaft | |

What is claimed is:

1. In a resistive thermal printer, a cylindrical platen roller for supporting a receiver medium on which an image is to be formed, the roller having an inner core and means for improving the registration of an image formed on a receiver medium, said means comprising an outer sleeve formed of a heat shrunk material having a frictional surface finish thereon.

2. A cylindrical platen roller as set forth in claim 1, wherein the inner core includes a compliant layer.

3. A cylindrical platen roller as set forth in claim 2, wherein the compliant layer is an elastomer.

4. A cylindrical platen roller as set forth in claim 1, wherein the inner core includes a compliant layer on a rigid shaft.

5. A cylindrical platen roller as set forth in claim 1, wherein the material is polyolefin.

6. A cylindrical platen roller as set forth in claim 2, wherein the compliant layer is flexible elastomer.

7. A cylindrical platen roller as set forth in claim 2, wherein the compliant layer is flexible neoprene elastomer.

8. A cylindrical platen roller as set forth in claim 2, wherein the compliant layer is flexible silicone elastomer.

9. A cylindrical platen roller as set forth in claim 2, wherein the compliant layer is fluoroelastomer.

10. A cylindrical platen roller as set forth in claim 1, wherein the material is cross-linked PVC.

11. A cylindrical platen roller as set forth in claim 1, further comprising a layer of adhesive between the core and the outer sleeve.

12. A resistive thermal printer for forming an image on a receiver medium, said printer comprising:

a thermal printhead having an array of selectively-activatable thermal elements; and a rotatable platen roller opposed to the printhead and forming a nip with the printhead through which a receiver medium is driven while the thermal elements are selectively activated, wherein the platen roller has a inner core and means for improving the registration of an image formed on a receiver medium, said means comprising an outer sleeve formed of a heat shrunk material having a frictional surface finish.

13. A resistive thermal printer as set forth in claim 12, wherein the inner core includes a compliant layer.

14. A resistive thermal printer as set forth in claim 13, wherein the compliant layer is an elastomer.

15. A resistive thermal printer as set forth in claim 12, wherein the inner core includes a compliant layer on a rigid shaft.

16. A resistive thermal printer as set forth in claim 12, wherein the material is polyolefin.

17. A resistive thermal printer as set forth in claim 13, wherein the compliant layer is flexible elastomer.

18. A resistive thermal printer as set forth in claim 13, wherein the compliant layer is flexible neoprene elastomer.

19. A resistive thermal printer as set forth in claim 13, wherein the compliant layer is flexible silicone elastomer.

20. A resistive thermal printer as set forth in claim 13, wherein the compliant layer is fluoroelastomer.

21. A resistive thermal printer as set forth in claim 12, wherein the material is cross-linked PVC.

22. A resistive thermal printer as set forth in claim 12, further comprising a layer of adhesive between the core and the outer sleeve.

23. A resistive thermal printer for forming an image on a receiver medium, said printer comprising:

a thermal printhead having an array of selectively-activatable thermal elements; and a rotatably-driven platen roller opposed to the printhead and forming a nip with the printhead through which a receiver medium is driven by the platen roller while the thermal elements are selectively activated, wherein the platen roller has an inner core and means for improving the registration of an image formed on a receiver medium, said means comprising an outer sleeve formed of a heat shrunk material having a frictional surface thereon.

24. A resistive thermal printer as set forth in claim 23, wherein the inner core includes a compliant layer.

25. A resistive thermal printer as set forth in claim 24, wherein the compliant layer is an elastomer.

26. A resistive thermal printer as set forth in claim 23, wherein the inner core includes a compliant layer on a rigid shaft.

27. A resistive thermal printer as set forth in claim 23, wherein the material is polyolefin.

28. A resistive thermal printer as set forth in claim 24, wherein the compliant layer is flexible elastomer.

29. A resistive thermal printer as set forth in claim 24, wherein the compliant layer is flexible neoprene elastomer.

30. A resistive thermal printer as set forth in claim 24, wherein the compliant layer is flexible silicone elastomer.

31. A resistive thermal printer as set forth in claim 24, wherein the compliant layer is fluoroelastomer.

32. A resistive thermal printer as set forth in claim 23, wherein the material is cross-linked PVC.

33. A resistive thermal printer as set forth in claim 23, further comprising a layer of adhesive between the core and the outer sleeve.

* * * * *